US006045965A

United States Patent [19]

Cournoyer et al.

[11] Patent Number: 6,045,965

[45] Date of Patent: Apr. 4, 2000

[54] PHOTOGRAPHIC MEMBER WITH PEELABLE AND REPOSITIONING ADHESIVE LAYER

[75] Inventors: Robert F. Cournoyer, Webster; Robert P. Bourdelais, Pittsford; Peter T. Aylward, Hilton, all of N.Y.

[73] Assignee: Eastman Kodak Company, Rochester, N.Y.

[21] Appl. No.: 09/196,545

[22] Filed: Nov. 20, 1998

[51] Int. Cl.[7] ..... G03C 1/805; G03C 1/79; G03C 11/12

[52] U.S. Cl. ..... 430/263; 430/201; 430/215; 430/259; 430/262; 430/536; 430/538; 347/106

[58] Field of Search ..... 430/201, 215, 430/259, 262, 263, 536, 538; 347/106

[56] References Cited

U.S. PATENT DOCUMENTS

| | | | |
|---|---|---|---|
| 3,359,107 | 12/1967 | Goffe et al. | 430/263 |
| 4,093,073 | 6/1978 | Leezer | 206/606 |
| 4,201,613 | 5/1980 | Olivieri et al. | 156/270 |
| 4,285,999 | 8/1981 | Olivieri et al. | 428/40 |
| 4,777,067 | 10/1988 | Woronow et al. | 428/59 |
| 5,292,154 | 3/1994 | Williams | 283/2 |
| 5,507,166 | 4/1996 | Orlick et al. | 72/344 |
| 5,853,965 | 12/1998 | Haydock et al. | 430/538 |
| 5,866,282 | 2/1999 | Bourdelais et al. | 430/538 |
| 5,874,205 | 2/1999 | Bourdelais et al. | 430/538 |

FOREIGN PATENT DOCUMENTS

| | | |
|---|---|---|
| 0 880 065 A1 | 11/1998 | European Pat. Off. . |
| 0 880 067 A1 | 11/1998 | European Pat. Off. . |
| 0 880 069 A1 | 11/1998 | European Pat. Off. . |
| 2 325 749 | 12/1998 | United Kingdom . |
| 2 325 750 | 12/1998 | United Kingdom . |

*Primary Examiner*—Richard L. Schilling
*Attorney, Agent, or Firm*—Paul A. Leipold

[57] ABSTRACT

The invention relates to a photographic element comprising at least one silver halide imaging layer, at least one biaxially oriented polyolefin sheet, and at least one layer comprising a peelable adhesive wherein said peelable adhesive will allow peelable separation of said photographic element at said adhesive layer and the repositioning of at least one of the separated parts of said photographic element by use of said at least one layer comprising a peelable adhesive.

28 Claims, No Drawings

PHOTOGRAPHIC MEMBER WITH PEELABLE AND REPOSITIONING ADHESIVE LAYER

FIELD OF THE INVENTION

This invention relates to photographic materials. In a preferred form it relates to photographic color paper with repositioning adhesive layer.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. Generally photosensitive paper is printed and processed with consumer images during a photoprocessing operation yielding consumer images in convenient sizes for viewing, display, and storage. Typically, consumer images are adhered to various surfaces such as refrigerators, photo albums, and display frames. At present, to adhere reflective images to various surfaces, the consumer is required to apply an adhesive on the backside of the image to adhere the image to various surfaces. In addition to adhesive, magnets and various adhesive tapes are also used. It would be desirable if photographic paper contained a peelable repositionable adhesive that could be activated by the consumer to allow an image to be adhered to various surfaces.

It has been proposed in U.S. Pat. No. 4,507,166 to apply an adhesive coated release sheet to the backside of exposed, developed photographic paper prior to the cutting of the photographic paper into strips or sheets. While this method of creating adhesive backed photographs does produce an acceptable adhesive backed image, it is inefficient and costly. The photofinisher must purchase additional special equipment and an adhesive coated release sheet to apply the adhesive to the backside of the photographic paper. It would be desirable if a photographic paper contained a repositionable adhesive that did not require the photofinisher to purchase extra materials or equipment to provide an adhesive backed photograph.

Present digital repositionable images that are typically used for stickers and dry mounting of digital images are constructed using a repositioning adhesive with an adhesive liner applied to the backside of the imaging layer. The adhesive system is typically applied in the manufacturing process for digital image support, and the adhesive is exposed by the consumer after the image has been formed in the digital imaging layer. The most widely used technology for the formation of the images is ink jet printing. While ink jet imaging does provide acceptable image quality for some repositionable imaging applications, it suffers from a long dry time and at present cannot match the image quality of silver halide imaging systems. There remains a need for a high quality silver halide reflective receiver with a peelable and repositionable adhesive layer.

In the formation of color paper it is known that the base paper has applied thereto a layer of polymer, typically polyethylene. This layer serves to provide waterproofing to the paper, as well as providing a smooth surface on which the photosensitive layers are formed. While the polyethylene does provide a waterproof layer to the base paper, the melt extruded polyethylene layer used in color paper has very little dimensional strength and, as a result, cannot be used alone as a carrier of an image. It has been proposed in U.S. Pat. No. 5,244,861 to utilize biaxially oriented polypropylene in receiver sheets for thermal dye transfer. In U.S. Pat. No. 5,244,861 high strength biaxially oriented sheets are laminated to cellulose paper with low density polyethylene. While the biaxially oriented sheet in U.S. Pat. No. 5,244,861 is an efficient thermal dye transfer support, the biaxially oriented layer cannot be stripped from the paper and reapplied to a different surface.

PROBLEM TO BE SOLVED BY THE INVENTION

There remains a need for improved methods for adhering photographic elements to substrates. It would be desirable if a photographic paper contained a repositioning adhesive layer below a high strength biaxially oriented polymer sheet for image stability. Further, there remains a need for an adherence method that it is integral with a photographic element during exposure and processing.

SUMMARY OF THE INVENTION

It is an object of the invention to overcome disadvantages of prior methods of adhering photographic images to substrates.

It is another object to provide improved photographic quality stickers.

It is a further object to provide improved mounting of photographs in photographic albums.

These and other objects of the invention are accomplished by a photographic element comprising at least one silver halide imaging layer, at least one biaxially oriented polyolefin sheet, and at least one layer comprising a peelable adhesive wherein said peelable adhesive will allow peelable separation of said photographic element at said adhesive layer and the repositioning of at least one of the separated parts of said photographic element by use of said at least one layer comprising a peelable adhesive.

ADVANTAGEOUS EFFECT OF THE INVENTION

The invention provides an improved method of mounting photographs onto substrates. It further provides an improved sticker of photographic quality.

DETAILED DESCRIPTION OF THE INVENTION

The invention has numerous advantages over prior practices in the art. The invention provides a photographic element that may be subjected to conventional photographic exposure and development processes and then peeled to form photographic elements that may be adhered to surfaces. These photographic elements may be in flexible sticker form. In another embodiment, the invention provides a method of incorporating means for dry mounting photographs to photograph albums. Further the photographs of the invention after peeling may be mounted to many non-traditional surfaces such as books, posters, school lockers, office walls, file cabinets and refrigerators. The materials if adhered to illuminated substrates such as lamp shades or windows may provide a illuminated image. Photographs of the invention may also be adhered back to back to form pages in a book, album or a technical report. A further advantage is that the thin biaxially oriented polyolefin sheet after separation from the substrate will provide a thinner image that will not increase the thickness of files to which photographs are attached. This is true as the bulk of the thickness of the photographic element is provided by the substrate, with transfer of the photographic image only on a biaxially oriented polyolefin sheet the thickness is only a fraction of the total thickness of the photographic element. The photographic element when only on the biaxially oriented polyolefin sheet film after peeling may be adhered to irregular and textured surfaces that cannot be previously easily coated with a photographic image. These type of surfaces would include fabrics, coarse paper, wood, fishing lures and restaurant menus. These and other advantages will be apparent from the detailed description below.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image. The term used herein "peelable adhesive" or "repositionable adhesive" means an adhesive material that has a peel strength less than 100 grams/cm. The term used herein "permanent adhesive" means as adhesive materials that has a peel strength of greater than 100 grams/cm. Peel strength is measured using an Instron gauge and peeling the sample at 180 degrees with a crosshead speed of 1.0 meters/min. The sample width is 5 cm and the distance peeled is 10 cm in length.

The photographic support of the invention comprises high strength biaxially oriented polyolefin sheets that are laminated to cellulose paper. The biaxially oriented sheets provide durability, curl resistance, and a smooth surface for the silver halide imaging layers. The photographic support of the invention also contains adhesive layers that can be exposed by the consumer to allow the consumer to adhere images to a variety of surfaces without the need to apply glue or tape to the images. The adhesive layers may be positioned between the top biaxially oriented sheet and the paper base for a thin photographic element, or positioned between the paper and the bottom biaxially oriented polyolefin sheet. A unique feature of this invention is the adhesives preferably are repositionable. A repositionable adhesive, an adhesive that has a peel strength less than 100 grams/cm, allows the image to be adhered to several surfaces as the image is moved by the consumer. This would allow an image, for example, to move from being adhered to a refrigerator at home to adhered to an office file at work without using tape or magnets.

The photographic support of this invention has layers of adhesives and biaxially oriented polyolefin sheets chosen to allow for traditional photographic processing equipment to be utilized during the development and printing of silver halide images. Because the adhesive is added to the photographic support during the manufacturing process, the invention is low in cost compared to post processing application of adhesive layers. Because the adhesive layers do not interfere with the viewing and handling of images, the support materials of this invention have the advantage of being suitable for the consumers' present uses, while allowing the consumer the option of using the adhesive layers and thus creating a more useful image. For example, the imaging materials of this invention can be converted into a thin imaging member that can be used as a sticker or a self-mounting support for storage in a photographic album.

Any suitable biaxially oriented polyolefin sheet may be used for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in U.S. Pat. Nos. 4,377,616; 4,758,462; and 4,632,869.

The core of the preferred top composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

$$\frac{\text{Composite Sheet Density}}{\text{Polymer Density}} \times 100 = \%\text{ of Solid Density}$$

Percent solid density should be between 45% and 100%, preferably between 67% and 100%. As the percent solid density becomes less than 67%, the composite sheet becomes less manufacturable due to a drop in tensile strength, and it becomes more susceptible to physical damage.

The total thickness of the top composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/mm$^2$/day/atm. This allows faster emulsion hardening, as the laminated support of this invention greatly slows the rate of water vapor transmission from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells and, thus, there is virtually no path open from one side of the voided-core to the other side through which gas or liquid can traverse.

The void-initiating material may be selected from a variety of materials and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension are preferred. As the agent, colloidal silica is preferred.

The void-initiating particles can also be inorganic spheres, including solid or hollow glass spheres, metal or ceramic beads or inorganic particles such as clay, talc, barium sulfate and calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. Whitening addenda known in the art include adding a white pigment, such as titanium dioxide, barium sulfate, clay, or calcium carbonate. Addenda also include fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred top biaxially oriented, microvoided sheet of the invention where the imaging layer are applied to the polyethylene skin is as follows:

| |
|---|
| Polyethylene skin with blue tint |
| Polypropylene with $TiO_2$ and optical brightener |
| Microvoided polypropylene layer |
| Polypropylene |

The sheet on the bottom side of the base paper opposite to the emulsion layers may be any suitable sheet having the required surface roughness and mechanical properties including energy to break and tensile strength. The lower or bottom sheet may or may not be microvoided. It may have the same composition as the sheet on the top side of the paper backing material. Biaxially oriented polymer backside sheets are conveniently manufactured by coextrusion of the sheet, which may contain several layers, followed by biaxial orientation. Such biaxially oriented sheets are disclosed in, for example, U.S. Pat. No. Pat. 4,764,425.

Suitable classes of thermoplastic polymers for the backside biaxially oriented sheet core and skin layers include polyolefins, polyesters, polyamides, polycarbonates, cellulosic esters, polystyrene, polyvinyl resins, polysulfonarnides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. No. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with one or more layers of the same polymeric material, or it can be made with layers of different polymeric composition. In the case of a multiple layer system, when different polymeric materials are used, an additional layer may be required to promote adhesion between noncompatible polymeric materials so that the biaxially oriented sheets do not have layer fracture during manufacturing or in the final imaging element format.

Biaxially oriented polyolefin sheets are preferred for the backside sheet of this invention because they are low in cost and provide sufficient mechanical properties. Suitable polyolefins for the core and skin layers include polypropylene, polyethylene, polymethylpentene, and mixtures thereof. Polyolefin copolymers, including copolymers of propylene and ethylene such as hexene, butene and octene are also useful.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature.

The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching. A typical biaxial orientation ratio for the machine direction to cross direction is 5:8. A 5:8 orientation ratio develops the mechanical properties of the biaxially oriented sheet in both the machine and cross directions. By altering the orientation ratio, the mechanical properties of the biaxially oriented sheet can be developed in just one direction or both directions.

In the photofinishing process it is necessary that the photofinishing machines chop rolls of photographic paper into the final image format. Generally, the photofinishing equipment is only required to make chops in the cross machine direction as the manufacturer of the imaging element has previously cut to-a width that is suitable for the photofinishing machine being utilized. It is necessary that these chops in the cross direction be accurate and cleanly made. Inaccurate cuts lead to fiber projections hanging from the prints which is undesirable. The undesirable fiber projections are primarily torn backside polymer sheet and not cellulose paper fiber. Further, poor cross machine direction cutting can lead to damaging of the edges of the final image. With imaging elements containing biaxially oriented sheets in the base, the standard photofinishing machine cutters have difficulty in producing edges free of fibrous projections.

In the photofinishing process it is necessary that the photofinishing machines punch index holes into the imaging element as it moves through the machine. An accurate or incomplete punching of these holes will lead to undesirable results, as the machine will not image the prints in the proper place. Further, failure to properly make index punches may lead to jamming as prints may be cut to a size which the machine cannot handle. Since punching in photographic processing equipment usually occurs from the emulsion side, the fracture mechanism of bottom of the photographic element is a combination of cracks originating from both the punch and die. With tight clearances, as in a punch and die set with less than 1,000,000 actuations, the cracks, originating from the tool edges, miss each other and the cut is completed by a secondary tearing process, producing a jagged edge approximately midway in bottom sheet thickness that is a function of punch and die clearance. As the punch and die begin to wear from repeated actuations, excessive clearance is formed allowing for extensive plastic deformation of the bottom sheet. When the crack finally forms, it can miss the opposing crack, separation is delayed and a long polymer burr can form in the punched hole. This long burr can cause unacceptable punched holes which can result in machine jams. For punching of the bottom biaxially oriented sheet of this invention the energy to break is a significant factor in determining the quality of the punched index hole. Lowering the energy to break the bottom sheet for punching allows for punching fracture to occur at lower punch forces and aids in the reduction of punch burrs in the punched hole. The energy to break for the bottom polymer sheets of this invention is defined as the area under the stress strain curve. Energy to break is measured by running a simple tensile strength test for polymer sheets at a rate of 4000% strain per min.

For imaging materials that are chopped or for imaging materials that are punched with an index hole, energy to break of less than $3.5\times10^7$ J/m$^3$ for the bottom biaxially oriented sheet in at least one direction is preferred. A biaxially oriented polymer sheet with an energy to break greater than $4.0\times10^7$ J/m$^3$ does not show significant improvement in chopping or punching. For photographic paper that is chopped in photofinishing equipment, an energy to break of less than $3.5\times10^7$ J/m$^3$ in machine direction is preferred since the chopping usually occurs in the cross direction.

For imaging elements of this invention, the most preferred energy to break is between $9.0\times10^5$ J/m$^3$ and $3.5\times10^7$ J/m$^3$. Bottom polymer sheets with an energy to break less than $5.0\times10^5$ J/m$^3$ are expensive in that the process yield for oriented bottom sheets are reduced as lower orientation ratios are used to lower the energy to break. An energy to break greater than $4.0\times10^7$ J/m$^3$ does not show significant improvement for punching and chopping over cast low density polyethylene sheets that are commonly used as backside sheets in prior art imaging supports.

The preferred thickness of the biaxially oriented sheet should be from 12 to 50 $\mu$m. Below 12 $\mu$m, the sheets may not be thick enough to minimize any inherent non-planarity in the support, would be more difficult to manufacture, and would not provide enough strength to provide curl resistance to a gel containing imaging layer such as a light sensitive silver halide emulsion. At thickness higher than 50 $\mu$m, little improvement in mechanical properties are seen, and so there is little justification for the further increase in cost for extra materials. Also at thickness greater than 50 $\mu$m, the force to punch an index hole in the photofinishing equipment is beyond the design force of some photofinishing equipment. Failure to complete a punch will result in machine jamming and loss of photofinishing efficiency.

The surface roughness of biaxially oriented film or $R_a$ is a measure of relatively finely spaced surface irregularities such as those produced on the backside of photographic materials by the casting of polyethylene against a rough chilled roll. The surface roughness measurement is a measure of the maximum allowable roughness height expressed in units of micrometers and by use of the symbol $R_a$. For the irregular profile of the backside of photographic materials of this invention, the average peak to valley height, which is the average of the vertical distances between the elevation of the highest peak and that of the lowest valley, is used.

Biaxially oriented polyolefin sheets commonly used in the packaging industry are commonly melt extruded and then orientated in both directions (machine direction and cross direction) to give the sheet desired mechanical strength properties. The process of biaxially orientation generally creates a surface roughness of less than 0.23 $\mu$m. While the smooth surface has value in the packaging industry, use as a backside layer for photographic paper is limited, as it does not contain the required roughness for efficient transport in photofinishing equipment and cannot be easily written on. Laminated to the backside of the base paper, the biaxially oriented sheet must have a surface roughness greater than 0.30 $\mu$m to ensure efficient transport through the many types of photofinishing equipment that have been purchased and installed around the world. At surface roughness less that 0.30 $\mu$m, transport through the photofinishing equipment becomes less efficient. At surface roughness greater than 2.54 $\mu$m, the surface would become too rough causing transport problems in photofinishing equipment, and the rough backside surface would begin to emboss the silver halide emulsion as the material is wound in rolls.

The surface roughness is accomplished by introducing addenda into the bottommost layer. The particle size of the addenda is preferably between 0.20 $\mu$m and 10 $\mu$m. At particles sizes less than 0.20 $\mu$m, the desired surface roughness cannot be obtained. At particles sizes greater than 10 $\mu$m, the addenda begins to create unwanted surface voids during the biaxially orientation process that would be unacceptable in a photographic paper application and would begin to emboss the silver halide emulsion as the material is wound in rolls. The preferred addenda to be added to the bottommost skin layer, to create the desired backside roughness, comprises a material selected from the group consisting of titanium dioxide, silica, calcium carbonate, barium sulfate, kaolin, and mixtures thereof.

Addenda may also be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

Another method of creating the desired roughness on the bottommost skin layer of a biaxially oriented sheet is the use of incompatible block copolymers. Block copolymers are polymers containing long stretches of two or more monomeric units linked together by chemical valences in one single chain. During the biaxially orientation of the sheet, the block copolymers do not mix and create desired surface roughness and a lower surface gloss when compared to homopolymers. The preferred block copolymers are mixtures of polyethylene and polypropylene.

In order to successfully transport a photographic paper that contains a laminated biaxially oriented sheet with the desired surface roughness, on the opposite side of the image layer an antistatic coating on the bottommost layer is preferred. The antistat coating may contain any known materials known in the art which are coated on photographic web materials to reduce static during the transport of photographic paper. The preferred surface resistivity of the antistat coat at 50% RH is less than $10^{-12}$ ohm/square.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma or corona discharge treatment to improve printability or adhesion.

The structure of a preferred biaxially oriented backside sheet of this invention with the skin layer on the bottom of the photographic element and the polypropylene layer is laminated to the paper base is as follows:

| |
|---|
| Polypropylene |
| Polyethylene and a terpolymer of ethylene propylene and butylene |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephthalate such as disclosed in U.S. Pat. Nos. 4,912,333; 4,994,312; and 5,055,371. The preferred substrate is a photographic grade cellulose fiber paper. A cellulose paper substrate is low in cost when compared to polymer substrates and cellulose paper provides the desired mechanical properties to give the image element the required stiffness.

Photographic elements which will allow peelable separation of the image and repositioning of the image by practice of this invention can vary greatly in the structure and composition of the support. In the simplest form a photographic element comprising at least one silver halide imaging layer, at least one biaxially oriented polyolefin sheet, and at least one layer comprising an adhesive wherein said adhesive will allow peelable separation of said photographic element at said adhesive layer and the repositioning of at least one of the separated parts of said photographic element by use of said at least one layer comprising an adhesive is preferred. This structure is preferred because it allows for a photographic image to be placed on a high strength, thin sheet of biaxially oriented polymer that can be efficiently repositioned at the convenience of the consumer. Prior art photographic peelable images have adhesive layers applied to the backside of the entire structure and as a result are thick, expensive and must use the paper to support the image. A thin, durable peelable image has significant commercial value as peelable images of this invention can be used as high quality stickers and to quickly and efficiently adhere images to a photo album.

A photographic element of this invention wherein the substrate has a biaxially oriented polyolefin sheet laminated to both the top and bottom of the substrate is preferred. For efficient photoprocessing of light sensitive silver halide images, it is desirable to use commercial photoprocessing equipment that is currently installed in photofinishing sites worldwide. For efficient photoprocessing, a back side sheet must have the required roughness for proper conveyance through the many types of printers, processors and finishing equipment that is typically available at photofinishing operations. A biaxially oriented sheet of this invention will provide the proper strength and roughness for efficient photoprocessing. Further, it has been found that biaxially oriented sheets applied to the top and bottom sides of the substrate reduce undesirable image curl.

Photographic support structures of this invention that contain biaxially oriented sheets applied to a base may have one of three following basic structures:

1. Adhesive located between the top biaxially oriented polyolefin sheet and the base material.
2. Adhesive located between the base material and the bottom biaxially oriented polyolefin sheet.
3. Adhesive located between both the top and the bottom biaxially oriented sheets and the substrate.

A photographic element of this invention where the adhesive layer is located between the top biaxially oriented polyolefin sheet and the substrate of this invention is preferred because it provides a photographic element that can be efficiently photoprocessed and allow for photographic image to be placed on a high strength, thin sheet of biaxially oriented polymer that can be efficiently repositioned at the convenience of the consumer. This has significant commercial value in that photographic images can be commercially processed and allow the consumer the option of separating the image layer from the substrate creating a thin, strong image that can easily be repositioned. Additionally, the thin strong image that contains an adhesive can be adhered to a surface that will allow back illumination of an image. An illuminated image has significant commercial value in commercial product display materials that are common in airports, store front windows and various forms public transportation.

A photographic element of this invention wherein said adhesive layer is located between the bottom biaxially oriented polyolefin sheet and the substrate of this invention is preferred because it allow for efficient photoprocessing of images and allows photographic images to be repositioned with the substrate adhered to the image layer. This structure has significant value in that consumers can reposition images containing the substrate on surfaces that typically require the consumer to add an adhesive on the back side of prior art photographic papers. Examples of surfaces include photo albums, refrigerators and books.

A photographic element of this invention wherein the adhesive layer is located between the top and bottom biaxially oriented polyolefin sheets and said substrate is preferred. An adhesive layer on both the top and bottom biaxially oriented sheets allow for efficient photoprocessing and allows the consumer to choose the appropriate separation. For example, one image might require separation between the top biaxially oriented polyolefin sheet and the substrate for application to a photo album and another image in might require peelable separation between the bottom biaxially oriented polyolefin sheet and the substrate for dry mounting for picture framing.

Adhesives utilized in this invention may be peelable or permanent. Peelable adhesive allow the image to be easily separated from a surface and can be reused. A permanent adhesive is difficult to separate from a surface and tend to be single use. Permanent adhesives are useful in applications where the image is intended to remain in the same position during the life of an image such as a photographic album or a framed image.

"Peelable separation" or "peel strength" or "separation force" is a measure of the amount of force required to separate the image between either the top biaxially oriented sheet or the bottom biaxially oriented sheet and the substrate. The peel strength is the amount of force required to separate two surfaces that are held together by internal forces of the adhesive which consist of valence forces or interlocking action, or both. Peel strength is measured using an Instron gauge and peeling the sample at 180 degrees with a crosshead speed of 1.0 meters/min. The sample width is 5 cm and the distance peeled is 10 cm in length. For a peelable adhesive the preferred peel strength between either the top biaxially oriented sheet or the bottom biaxially oriented sheet and the substrate is no greater than 80 grams/cm. At a peel strength greater than 100 grams/cm, consumers would begin to have difficulty separating the image from the support. Further, at peel strengths greater than 110 grams/cm, the force is beginning to approach the internal strength of paper substrate, causing an unwanted fracture of the paper substrate before the separation of the image.

Upon separation of the image from the substrate, the peelable adhesive of this invention has a preferred repositioning peel strength between 20 grams/cm and 100 grams/cm. Repositioning peel strength is the amount of force required to peel, at 180 degrees, the separated (and repositioned) image containing an adhesive from a stainless steel block having a 0.2 $\mu$m roughness at 23° C. and 50% RH. Peel strength is measured using an Instron gauge and peeling the sample at 180 degrees with a crosshead speed of 1.0 meters/min. The sample width is 5 cm and the distance peeled is 10 cm in length. At repositioning peel strengths less than 15 grams/cm, the adhesive lacks sufficient peel strength to remain adhered to a variety of surfaces such as refrigerators or photo albums. At peel strengths greater than 120 grams/cm, the adhesive of this invention is too aggressive, not allowing the consumer to later reposition the image.

The peelable adhesive of this invention may be a single layer or two or more layers. For two or more adhesive layers, one of the adhesive layers preferentially adheres of the biaxially oriented sheet. As the image is separated from the substrate, this allows the adhesive of this invention be adhered to the biaxially oriented sheet for repositioning. For two or more adhesive layers, one of the adhesive layers preferentially adheres to the substrate. As the bottom biaxially oriented sheet is separated from the image and substrate, this allows the adhesive of this invention to be adhered to the substrate for repositioning. For two or more adhesive layers, at least one of said layers on the top of said substrate preferentially adheres to biaxially oriented polyolefin sheet and at least one of said adhesive layers on the bottom of said substrate preferentially adheres to said substrate. This adhesive configuration allows for both types of separation, separation of the image layer and the top biaxially oriented polyolefin sheet and separation of the image layer with the substrate. Both types of separation allow for consumer choice as to the separation mode.

A substrate that comprises a release layer for said adhesive that repositions is preferred. The release layer allows for uniform separation of the adhesive at the adhesive substrate interface. The release layer may be applied to the substrate by any method known in the art for applying a release layer to substrates. Examples include a silicon coatings, tetrafluoroethylene flurocarbon coatings, fluorinated ethylene-propylene coatings and calcium stearate.

Suitable peelable adhesives of this invention must not interact with the light sensitive silver halide imaging system so that image quality is deteriorated. Further, since photographic elements of this invention must be photoprocessed, the performance of the adhesive of this invention must not be deteriorated by photographic processing chemicals. Suitable adhesive may be inorganic or organic, natural or synthetic, that is capable of bonding the image to the desired surface by surface attachment. Examples of inorganic adhesives are soluble silicates, ceramic and thermosetting powdered glass. Organic adhesives may be natural or synthetic. Examples of natural organic adhesives include bone glue, soybean starch cellulosics, rubber latex, gums, terpene, mucilages and hydrocarbon resins. Examples of synthetic organic adhesives include elastomer solvents, polysulfide sealants, theromplastic resins such as isobutylene and polyvinyl acetate, theromsetting resins such as epoxy, phenoformaldehyde, polyvinyl butyral and cyanoacrylates and silicone polymers.

For single or multiple layer adhesive systems, the preferred adhesive composition is selected from the group consisting of natural rubber, syntheic rubber, acrylics, acrylic copolymers, vinyl polymers, vinyl acetate-, urethane, acrylate- type materials, copolymer mixtures of vinyl chloride-vinyl acetate, polyvinylidene, vinyl acetate-acrylic acid copolymers, styrene butadiene, carboxylated stryrene butadiene copolymers, ethylene copolymers, polyvinyl alcohol, polyesters and copolymers, cellulosic and modified cellulosic, starch and modified starch compounds, epoxies, polyisocyanate, polyimides.

Water based pressure sensitive adhesion provide some advantages for the manufacturing process of non solvent emissions. Repositionable peelable adhesive containing non-adhesive solid particles randomly distributed in the adhesive layer aids in the ability to stick and then remove the print to get the desired end result. The most preferred pressure sensitive peelable adhesive is a respositionable adhesive layer containing at about 5% to 20% by weight of a permanent adhesive such as isooctyl acrylate/acrylic acid copolymer and at about 95% to 80% by weight of a tacky elastomeric material such as acrylate microspheres with the adhesive layer coverage at about 5 to 20 g/m$^2$.

The preferred peelable adhesive materials may be applied using a variety of methods known in the art to produce thin, consistent adhesive coatings. Examples include gravure coating, rod coating, reverse roll coating and hopper coating. The adhesives may be coated on the biaxially oriented sheets of this invention prior to lamination or may be used to laminate the biaxially oriented sheets to the paper.

For single or multiple layer adhesive systems, the preferred permanent adhesive composition is selected from the group consisting of epoxy, phenoformaldehyde, polyvinyl butyral, cyanoacrylates, rubber based adhesives, styrene/butadiene based adhesives, acrylics and vinyl deratives. Peelable adhesives and permanent adhesives may be used in combination in the same layer or in different locations in the photographic support structure. An example of a combination adhesive structure is a peelable adhesive between the top biaxially oriented sheet and the base materials and a permanent adhesive between the bottom biaxially oriented sheet and the base material.

When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an melt extruded adhesive between them followed by their being pressed in a nip such as between two rollers. The extruded polyolefin resin may be applied to either the biaxially oriented sheets or the base paper prior to their being brought into the nip. In a preferred form the extruded polyolefin resin is applied into the nip simultaneously with the biaxially oriented sheets and the base paper. The extruded polyolefin resin may be any suitable material that does not have a harmful effect upon the photographic element. A preferred material for extrusion lamination is a metallocene catalyzed ethylene plastomer that is melted at the time it is placed into the nip between the paper and the biaxially oriented sheet. Slip agents may be added to the extruded polyolefin resin to improve the release characteristics between the peelable or permanent adhesives of this invention and the extruded lamination resins. A preferred slip agent for extruded polyolefin resin is calcium stearate.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and back side film to keep curl to a minimum.

The support materials of this invention preferably are coated with silver halide imaging layers or digital imaging layers such as ink jet printing or thermal dye transfer. As used herein, the phrase "imaging element" is a materials that utilized ink jet or thermal dye transfer printing in the formation of images. Digital imaging systems are preferred because they avoid the need for expensive photographic processing equipment as the image can easily be formed on low cost ink jet or thermal dye transfer equipment in the home or office. Digital imaging layers may be any materials that are known in the art such as such as gelatin, pigmented latex, polyvinyl alcohol, polycarbonate, polyvinyl pyrrolidone, starch and methacrylate.

As used herein, the phrase "photographic element" is a material that utilizes photosensitive silver halide in the formation of images. The photographic elements can be black and white, single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The invention may be utilized with the materials disclosed in *Research Disclosure*, 40145 of September 1997. The invention is particularly suitable for use with the materials of the color paper examples of sections XVI and XVII. The couplers of section II are also particularly suitable. The Magenta I couplers of section II, particularly M-7, M-10, M-11, and M-18 set forth below are particularly desirable.

M-7

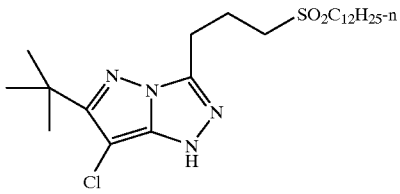

M-10

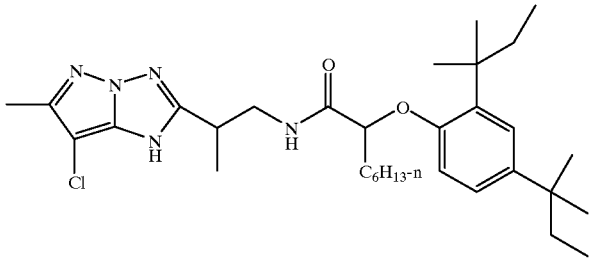

M-11

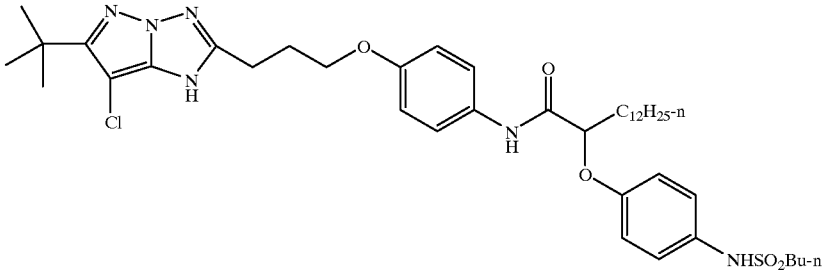

M-18

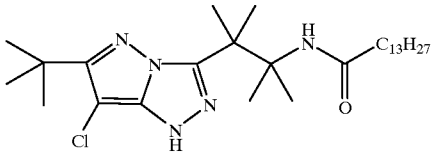

In order to successfully transport display materials of the invention, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hygroscopic compounds such as polyethylene glycols and hydrophobic slip additives that reduce the coefficient of friction of the web materials. An antistatic coating applied to the opposite side of the image layer or incorporated into the backside polymer layer is preferred. The backside is preferred because the majority of the web contact during conveyance in manufacturing and photoprocessing is on the backside. The preferred surface resistivity of the antistat coat at 50% RH is less than $10^{13}$ ohm/square. A surface resistivity of the antistat coat at 50% RH is less than $10^{13}$ ohm/square has been shown to sufficiently reduce static fog in manufacturing and during photoprocessing of the image layers.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX, A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |

-continued

| Reference | Section | Subject Matter |
|---|---|---|
| 1 | VIII | |
| 2 | VIII, XIII, XVI | Absorbing and scattering materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | |
| 2 | XVII | Supports |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | |
| 2 | XIX, XX, XXII | Chemical processing; Developing agents |
| 3 | XVIII, XIX XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Example 1

In this example a top and bottom biaxially oriented polyolefin sheet was laminated to a cellulose paper base to create a photographic support for silver halide imaging layers. Between the cellulose paper base and the top and bottom biaxially oriented polyolefin sheet, a layer of peelable, repositionable pressure sensitive adhesive was applied. Calcium stearate was used as a release for the pressure sensitive adhesive materials in this example. This example will show a photographic reflective print material that, upon separation of the top biaxially oriented sheet, was a thin, strong, and durable image, or upon separation of the bottom biaxially oriented sheet was a photographic reflective print that can be applied to a variety of surfaces. Further, this example shows that the invention can be printed and developed utilizing existing photographic processing equipment.

The following laminated photographic base was prepared by extrusion laminating pressure sensitive adhesive coated biaxially oriented polyolefin sheets to the top and bottom sides of the photographic grade cellulose paper base:

Photographic Cellulose Paper:

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

The following biaxially oriented, microvoided top sheet was extrusion laminated to the emulsion side of a photographic grade cellulose paper base using 1924P, an extrusion grade low density polyethylene with a density of 0.923 g/cm$^3$, and a melt index of 4.2. 10% by weight of calcium stearate was blended with the 1924P prior to extrusion coating in a resin blender:

Top Biaxially Oriented Sheet: (Emulsion side)

OPPalyte 350 ASW (Mobil Chemical Co.), a composite sheet (31 $\mu$m thick) (d=0.68 g/cc) consisting of a microvoided and oriented polypropylene core (approximately 60% of the total sheet thickness), with a homopolymer non-microvoided oriented polypropylene layer on each side; the void initiating material used is poly(butylene terephthalate).

A repositionable adhesive was reverse roll coated on the OPPalyte 350ASW just prior to extrusion lamination with the 1924P. The adhesive layer contained 15% by weight of isooctyl acrylate/acrylic acid copolymer and 85% by weight of elastomeric acrylate microspheres. The adhesive layer coverage was 12 g/m$^2$.

The following biaxially oriented bottom sheet was extrusion laminated to the bottom side of a photographic grade cellulose paper base using 1924P, an extrusion grade low density polyethylene with a density of 0.923 g/cm$^3$, and a melt index of 4.2:

Bottom Biaxially Oriented Sheet:

BICOR 70 MLT (Mobil Chemical Co.), a one-side matte finish, one-side treated biaxially oriented polypropylene sheet (18 $\mu$m thick) (d=0.9 g/cc) consisting of a solid oriented polypropylene core with 10% by weight of calcium stearate and a skin layer of a mixture of polyethylenes and a terpolymer of ethylene-propylene-butylene with a orientation ratio of 5:8. The polypropylene core side was laminated to the cellulose paper exposing the skin layer of block copolymer.

A peelable adhesive was reverse roll coated on the 70MLT just prior to extrusion lamination with the 1924P. The adhesive layer was coated on the polypropylene layer. The adhesive layer contained 15% by weight of isooctyl acrylate/acrylic acid copolymer and 85% by weight of elastomeric acrylate microspheres. The adhesive layer coverage was 12 g/m$^2$.

The structure below shows the composition of the photographic support used in this example:

| |
|---|
| OPPalyte 350 ASW |
| 15% by weight of isooctyl acrylate/acrylic acid copolymer |
| 85% by weight of elastomeric acrylate microspheres. |
| Low density polyethylene with 10% by weight of calcium stearate |
| Cellulose paper base |
| Low density polyethylene |
| 15% by weight of isooctyl acrylate/acrylic acid copolymer |
| 85% by weight of elastomeric acrylate microspheres. |
| Bottom oriented polymer sheet with 10% by weight of calcium stearate |

The photographic base of this example was light sensitive silver halide emulsion coated using coating format 1 detailed below. Coating format 1 was coated on the 350ASW surface.

| | Coating Format 1 | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

APPENDIX
Y-1
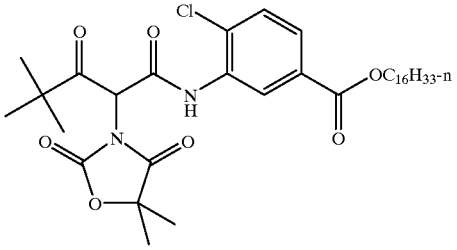
ST-1 = N-tert-butylacrylamide/n-butyl acrylate copolymer (50:50)
S-1 = dibutyl phthalate
SC-1
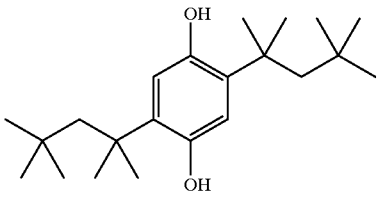
M-1
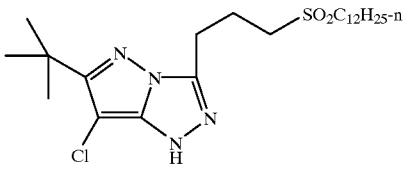
S-2 = diundecyl phthalate
ST-2
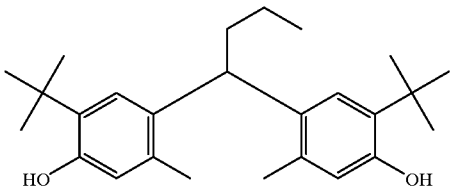
ST-3
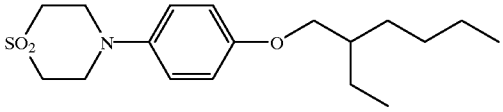
ST-4
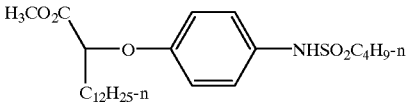
UV-1
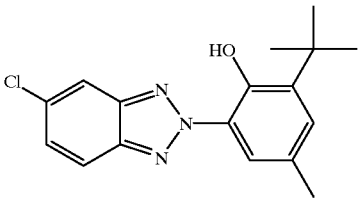

APPENDIX-continued

UV-2

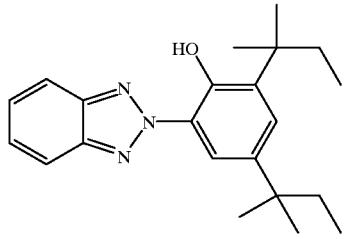

S-3 = 1,4-Cyclohexyldimethylene bis(2-ethylhexanoate)

C-1

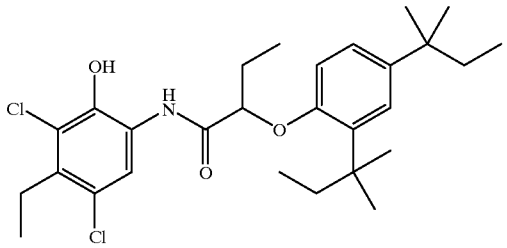

S-4 = 2-(2-Butoxyethoxy)ethyl acetate

Dye 1

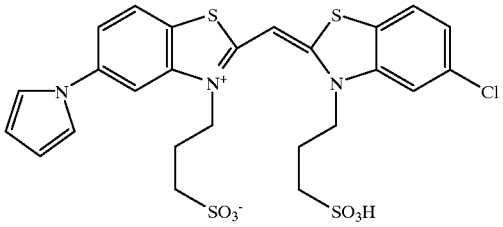

The silver halide coated support was converted into 10 cm rolls for the printing of images in a Gretag Master Lab 750. Printed images were evaluated for the force required to separate the image at the adhesive layer and the force required to peel the image from a stainless steel block at 23° C. and 50% RH. The stainless steel block was used as a reference materials to test the repositioning force of the images. The peel forces were measured on an Instron using the 180° peel test at a crosshead speed of 1.0 meters/min and a peel distance of 10 cm. The sample width used was 5 cm. The peel strength values for the force required to peel the listed image layer and peel the repositioned imaging layer are listed in Table 1 below.

TABLE 1

| | Image Peel Strength (grams/cm) | Reposition Peel Strength (grams/cm) |
|---|---|---|
| Top Sheet | 38 | 32 |
| Bottom Sheet | 44 | 41 |

These results are significant as this examples demonstrates two peelable and repositionable photographic layers. The peel strength is high enough to allow for efficient photographic processing using conventional minilab equipment, yet low enough to allow for easy separation by consumers. This structure also allows consumer flexibility, as the consumer can either peel the top layer yielding a thin (38 μm) photographic image that can be repositioned or a thick (205 μm) photographic image that can also be repositioned. This invention has significant commercial value over prior art digital peelable image layers, as the image quality of silver halide technology is superior to present day ink jet images. Further, this invention provides a lower cost silver halide peelable image over prior art silver halide system which requires a post processing application of the adhesive layer, as the peelable adhesive utilized in the invention is applied during manufacturing not requiring additional materials and equipment in photographic processing. The invention can be processed on traditional photographic processing equipment such as the Gretag 750 Masterlab used in this example, thus no additional expensive photographic processing equipment is required for the printing and development of images that contain adhesive layers.

While the two layers of peelable and repositioning adhesives used in this example were vastly superior to the prior art photographic images with adhesive layers. Permanent adhesive layers could also be used in place of one of the layers of repositioning adhesive when a single adhesive layer is desired. A permanent adhesive layer will allow for an image to be adhered to a surface for the life of the image and is particularly useful when adhering images by use of one repositioning layer to photographic albums, equipment displays such as an automobile instrument display panel, advertising and signs. For many uses the consumer would only need the option of one repositioning layer rather than the two peelable layers shown by the Example.

The invention has been described in detail with particular reference to certain preferred embodiments thereof, but it will be understood that variations and modifications can be effected within the spirit and scope of the invention.

What is claimed is:

1. A photographic element comprising at least one silver halide imaging layer, at least one biaxially oriented polyolefin sheet, and at least one layer comprising a peelable adhesive wherein said peelable adhesive will allow peelable separation of said photographic element at said adhesive layer and the repositioning of at least one of the separated parts of said photographic element by use of said at least one layer comprising a peelable adhesive.

2. The photographic element of claim 1 further comprising a substrate and wherein said substrate has a biaxially oriented polyolefin sheet on both the top and bottom of said substrate.

3. The photographic element of claim 2 wherein said peelable adhesive layer is located between the top biaxially oriented polyolefin sheet and said substrate.

4. The photographic element of claim 2 wherein said peelable adhesive layer is located between the bottom biaxially oriented polyolefin sheet and said substrate.

5. The photographic element of claim 2 wherein a peelable adhesive layer is located between both the top and bottom biaxially oriented polyolefin sheets and said substrate.

6. The photographic element of claim 1 wherein said peelable adhesive layer comprises a single layer of adhesive.

7. The photographic element of claim 1 wherein said adhesive layer comprises at least two adhesive layers, wherein at least one of said layers comprises peelable adhesive that preferentially adheres to biaxially oriented polyolefin sheet.

8. The photographic element of claim 2 wherein said at least one peelable adhesive layer comprises at least two adhesive layers, wherein at least one of said layers preferentially adheres to said substrate.

9. The photographic element of claim 5 wherein said peelable adhesive layer comprises at least two peelable adhesive layers, wherein at least one of said layers on the top of said substrate preferentially adheres to biaxially oriented polyolefin sheet and wherein at least one of said adhesive layers on the bottom of said substrate preferentially adheres to said substrate.

10. The photographic element of claim 1 wherein said peelable adhesive for repositioning has a peel strength of no greater than 100 grams/cm.

11. The photographic element of claim 1 wherein said peelable adhesive composition is selected from the group consisting of natural rubber, syntheic rubber, acrylics, acrylic copolymers, vinyl polmers, vinyl acetate-, urethane, acrylate- type materials, copolymer mixtures of vinyl chloride-vinyl acetate, polyvinylidene, vinyl acetate-acrylic acid copolymers, stryene butadiene, carboxylated stryrene butadiene copolymers, ethylene copolymers, polyvinyl alchohol, polyesters and copolymers, cellulosic and modified cellulosic, strach and modified starches compounds, epoxies, polyisocyanate, polyimides.

12. The element of claim 11 wherein said peelable adhesive is a water based pressure sensitivity adhesive.

13. The element of claim 12 wherein the pressure sensitive adhesive is a repositionable adhesive layer containing non-adhesive solid particles randomly distributed in said adhesive layer.

14. The element of claim 12 wherein the pressure sensitive adhesive is a repositionable adhesive layer containing at about 5 to 20% by weight of a permanent adhesive such as isooctyl acrylate/acrylic acid copolymer and at about 95 to 80% by weight of a tacky elastomeric material such as acrylate microspheres with the adhesive layer coverage at about 5 to 20 $g/m^2$.

15. The photographic element of claim 10 wherein said peelable adhesive has a peel strength between 20 and 100 grams/cm.

16. The photographic element of claim 1 wherein the adhesive is not deteriorated by photographic processing chemicals.

17. The photographic element of claim 2 wherein said substrate further comprises a release layer for said peelable adhesive.

18. A imaging element comprising a ink or dye receiving layer, at least one biaxially oriented polyolefin sheet, and at least one layer comprising peelable adhesive wherein said peelable adhesive will allow peelable separation of said imaging element at said adhesive layer and the repositioning of at least one of the separated parts of said imaging element by use of said at least one layer comprising a peelable adhesive.

19. The imaging element of claim 18 further comprising a substrate and wherein said substrate has a biaxially oriented polyolefin sheet on both the top and bottom of said substrate.

20. The imaging element of claim 19 wherein said peelable adhesive layer is located between the top biaxially oriented polyolefin sheet and said substrate.

21. The imaging element of claim 19 wherein said peelable adhesive layer is located between the bottom biaxially oriented polyolefin sheet and said substrate.

22. The imaging element of claim 19 wherein a peelable adhesive layer is located between both the top and bottom biaxially oriented polyolefin sheets and said substrate.

23. The imaging element of claim 18 wherein said peelable adhesive layer comprises a single layer of adhesive.

24. The imaging element of claim 18 wherein said adhesive layer comprises at least two adhesive layers, wherein at least one of said layers comprises peelable adhesive that preferentially adheres to biaxially oriented plyolefin sheet.

25. The imaging element of claim 19 wherein said at least one peelable adhesive layer comprises at least two adhesive layers, wherein at least one of said layers preferentially adheres to said substrate.

26. The imaging element of claim 18 wherein said peelable adhesive for repositioning has a peel strength of no greater than 100 grams/cm.

27. The imaging element of claim 26 wherein said peelable adhesive has a peel strength between 20 and 100 grams/cm.

28. The imaging element of claim 19 wherein said substrate further comprises a release layer for said peelable adhesive.

* * * * *